US005178337A

United States Patent [19]

Lupoli

[11] Patent Number: 5,178,337

[45] Date of Patent: Jan. 12, 1993

[54] PILL CRUSHER

[76] Inventor: Paul Lupoli, 87-18 90th St., Woodhaven, N.Y. 11421

[21] Appl. No.: 747,629

[22] Filed: Aug. 20, 1991

[51] Int. Cl.[5] ..... B02C 19/08

[52] U.S. Cl. ..... 241/169; 241/DIG. 27

[58] Field of Search ..... 241/169, 168, 266, DIG. 27; 30/120.5, 232, 231

[56] References Cited

U.S. PATENT DOCUMENTS

| | | | |
|---|---|---|---|
| 632,444 | 9/1899 | Chaussinand | 241/169 |
| 979,364 | 12/1910 | Baudement et al. . | |
| 1,038,469 | 9/1912 | Wood | 241/169 |
| 1,134,265 | 4/1915 | Harper . | |
| 1,162,141 | 11/1915 | De Arment | 241/168 |
| 1,262,303 | 4/1918 | Broadbooks | 30/231 |
| 2,631,786 | 3/1953 | Morgan et al. . | |
| 2,986,346 | 5/1961 | Rozmus | 241/169 |
| 3,915,393 | 10/1975 | Elkins . | |
| 4,003,523 | 1/1977 | Doolittle . | |
| 4,984,368 | 1/1991 | Hoover et al. | 30/231 |
| 5,025,996 | 6/1991 | Lavin et al. | 241/168 |

FOREIGN PATENT DOCUMENTS

| | | | |
|---|---|---|---|
| 41449 | 10/1916 | Sweden | 241/168 |

*Primary Examiner*—Mark Rosenbaum
*Assistant Examiner*—John M. Husar
*Attorney, Agent, or Firm*—Jacobson, Price, Holman & Stern

[57] ABSTRACT

A pill crusher has a pair of pivoted handles each including a serrated jaw for crushing pills therebetween. Each jaw includes a handle-engaging portion substantially perpendicular to the jaw surface. The serrated jaw surfaces extend outwardly from the handles and have a convex curved outer perimeter for resting against a hand receiving a crushed pill. The device has finger-retaining rings and is opened and closed similarly to scissors.

1 Claim, 1 Drawing Sheet

PILL CRUSHER

FIELD OF THE INVENTION

The invention relates to a device for crushing pills to facilitate swallowing.

BACKGROUND OF THE INVENTION

Devices for use in crushing pills are not always easy to use or efficient. Elkins, U.S. Pat. No. 3,915,393, describes a medication crushing device in which the pill is placed in a cup before crushing. The pill crusher of Doolittle, U.S. Pat. No. 4,003,523, describes a pill crusher which operates on the same principle as a pestle and mortar. U.S. Pat. No. 2,631,786, to Morgan et al., describes a tablet crusher which is spring loaded and in which a crushing head may have a single serrated surface.

The patent to Baudement et al., U.S. Pat. No. 979,364, describes a serrated sugar crusher having pivoted handles. Harper U.S. Pat. No. 1,132,265, describes a nut cracker which operates similarly.

None of these patents describe a pill crushing device having the advantages and ease of use of the device described herein.

SUMMARY OF THE INVENTION

A pill crusher of the invention has a pair of elongated handles pivoted together at one end. Each handle has a finger retaining ring at the other end. A pair of serrated pill-engaging jaws are riveted, one to each pivoted handle. The pill engaging jaws mesh together when the pill crusher is closed. To use the device, the serrated jaws are opened in the same way that scissors are opened. A pill is placed between the serrated jaws and the handles are gripped together until the pill is crushed. The serrated jaws have a curved outer perimeter which fits the palm of a hand. The jaws may be safely opened onto the palm, without risk of losing any of the pieces of the crushed pill.

It is an object of the invention to provide a simple, easy to use device for crushing pills, particularly large pills, to permit easy swallowing.

DETAILED DESCRIPTION OF THE INVENTION

A pill crushing device of the invention is simple and efficient to use. The device has finger-retaining rings and is opened and closed like scissors. A pill is placed between the serrated jaws of the pill crusher and the handles of the device are gripped together, crushing the pill. Edges of the serrated jaws are curved to fit the contour of the palm of a hand and the crushed pill is emptied into the palm without risk of spilling the crushed pill.

Figure 3:
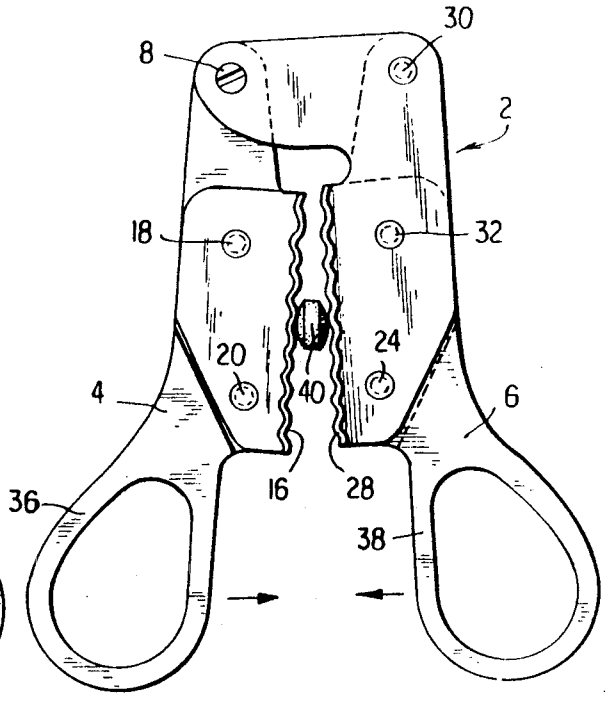
FIG. 3 is a top plan view of the device FIG. 1, as used.
Figure 2:
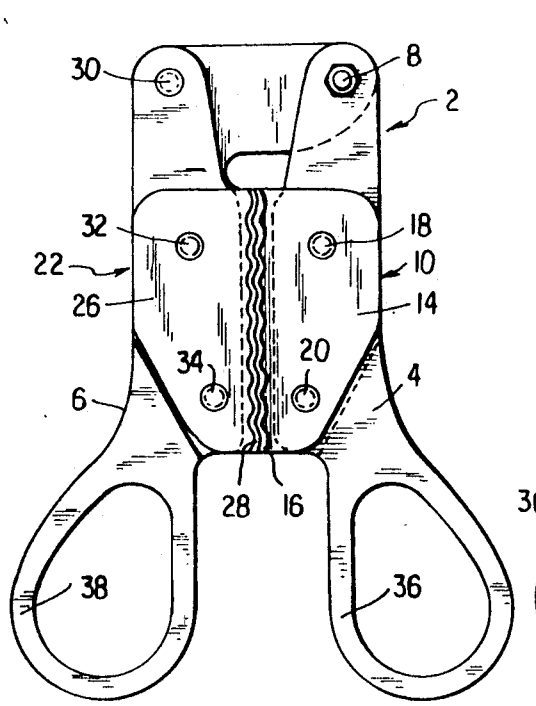
FIG. 2 is a bottom plan view of the pill crush FIG. 1.
Figure 1:
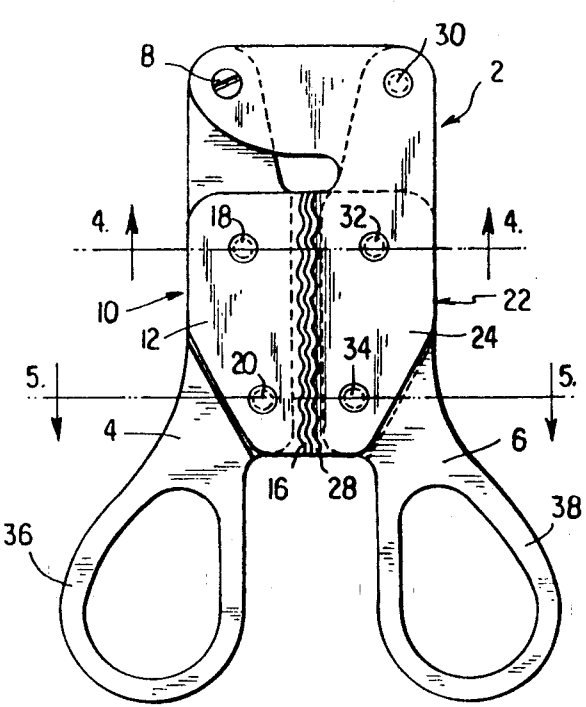
FIG. 1 is a top plan view of a pill crushing device of the invention.
Figure 5:
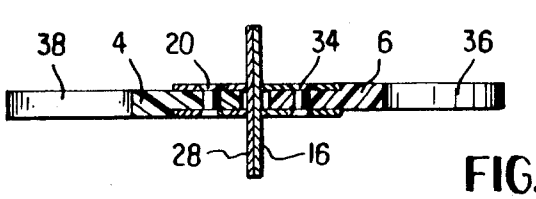
FIG. 5 is a cross-sectional view taken on line 5—5 of FIG. 1.
Figure 4:
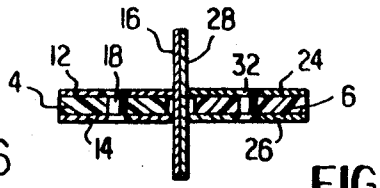
FIG. 4 is a cross-sectional view taken on line 4—4 of FIG. 1.

FIGS. 1 to 6, in which like numerals represent like parts, illustrate pill crusher 2. As shown in FIGS. 1 to 3, pill crusher 2 has a pair of handles 4, 6 which are pivoted together at pivot 8.

FIGS. 1 to 5 illustrate jaw 10 which includes plates 12, 14 and pill-engaging serrated surface 16 is joined to handle 4 by rivets 18, 20. Plates 12, 14 are spaced apart by the thickness of handle 4. Pill-engaging serrated surface 16 is substantially perpendicular to plates 12, 14. Jaw 22 which includes plates 24, 26 and pill-engaging serrated surface 28 is joined to handle 6 by rivets 30, 32 and 34. Plates 24, 26 are spaced apart by the thickness of handle 6. Pill-engaging serrated surface 28 is substantially perpendicular to plates 24, 26. Handles 4, 6 include finger retaining rings 36, 38 at their respective ends distant from pivot 8.

Pivot 8 is offset to one side of the the pill engaging serrated surfaces. Pivot 8 connects handle 4 and plate 24, allowing handles 4 and 6 to be readily separated for inserting a pill between the serrated surfaces. Other arrangements of the various plates which allow the handles to pivot and the serrated surface to be substantially perpendicular to the plates are within the scope of the invention.

Figure 6:
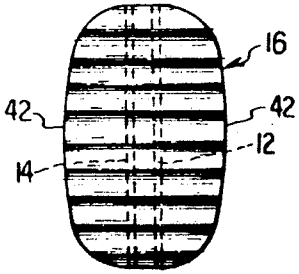
FIG. 6 is a plan view of a pill-engaging serrated surface.

Plate 24 extends across to pivot 8, allowing the handles to be opened to insert a pill 40 between serrated surfaces 16, 28. When the handles are gripped together by movement in the direction of the arrows shown in FIG. 3, pill 40 is crushed. Serrated surface 16, shown in FIG. 6, is typical of both surfaces 16, 28, and has a convex curved outer perimeter 42 extending outwardly from the handles. The pattern of serrations may be any appropriate pattern known to one skilled in the art which holds a pill securely and facilitates crushing.

In use, pill 40 is placed between surfaces 16, 28 and handles 4, 6 are gripped together by one hand, crushing pill 40. Perimeter edges 42 are positioned against a palm of the other hand (not the hand holding the pill crusher), and the crushed pill is safely emptied into the palm, without any likelihood of spilling the crushed pill.

The pill crusher may be made of any suitable materials. In a typical non-limiting example, the handles may be plastic and the handle-engaging plates and the serrated pill-engaging surfaces may be metal. Other appropriate materials will be known to one skilled in the art.

While the invention has been described with respect to certain embodiments thereof, it will be appreciated that variations and modifications ma be made without departing from the spirit and scope of the invention.

What is claimed is:

1. A pill crusher comprising:

first and second handles pivoted together at first ends thereof and having finger retaining rings at second ends thereof;

a first transversely serrated pill-engaging jaw comprising a first handle-engaging portion rigid with said first handle substantially perpendicular to and rigid with a first serrated pill-engaging surface wherein said first handle-engaging portion further comprises pivot means offset from the first pill-engaging surface for pivoting said first and second handles;

a second transversely serrated pill-engaging jaw able to mesh with said first serrated jaw comprising a second handle-engaging portion rigid with said second handle substantially perpendicular to and rigid with a second serrated pill-engaging surface engaged with said second handle;

said pivot means being offset from the second pill-engaging surface and spaced laterally from a plane passing centrally between said pill-engaging surfaces;

wherein said first and second serrated pill-engaging surfaces extend substantially perpendicularly to the plane of said handles and mesh together, each said surface comprising a convex curved outer perimeter extending outwardly from said handles for engaging a palm of a user's hand; and wherein a pill placed between said first and second serrated surfaces is crushed when said first and second handles are gripped together.

* * * * *